US007065982B2

(12) United States Patent
Schmid et al.

(10) Patent No.: US 7,065,982 B2
(45) Date of Patent: Jun. 27, 2006

(54) EVAPORATOR FOR REFRIGERATION SYSTEMS

(75) Inventors: Alexandre Cury Schmid, Joinville (BR); Jose Alberto Correa Salles, Joinville (BR)

(73) Assignee: Multibras S.A. Eletrodomesticos, Sao Paulo (BR)

( * ) Notice: Subject to any disclaimer, the term of this patent is extended or adjusted under 35 U.S.C. 154(b) by 148 days.

(21) Appl. No.: 10/497,623

(22) PCT Filed: Dec. 3, 2002

(86) PCT No.: PCT/BR02/00169

§ 371 (c)(1),
(2), (4) Date: Aug. 16, 2004

(87) PCT Pub. No.: WO03/048660

PCT Pub. Date: Jun. 12, 2003

(65) Prior Publication Data

US 2005/0000238 A1 Jan. 6, 2005

(30) Foreign Application Priority Data

Dec. 4, 2001 (BR) ..... 0106577

(51) Int. Cl.
*F25B 39/02* (2006.01)

(52) U.S. Cl. ..... 62/515

(58) Field of Classification Search ..... 62/515, 62/518, 520; 165/151

See application file for complete search history.

(56) References Cited

U.S. PATENT DOCUMENTS

| | | | | |
|---|---|---|---|---|
| 2,613,065 A | | 10/1952 | Didier | |
| 4,369,350 A | | 1/1983 | Kobayashi | |
| 4,881,311 A | * | 11/1989 | Paulman et al. | 29/890.047 |
| 5,186,022 A | | 2/1993 | Kim | |
| 5,540,276 A | * | 7/1996 | Adams et al. | 165/151 |
| 6,253,839 B1 | | 7/2001 | Reagen | |

FOREIGN PATENT DOCUMENTS

| | | |
|---|---|---|
| EP | 0 537 650 A2 | 4/1993 |
| GB | 867598 A1 | 5/1961 |
| WO | WO-01/57456 A1 | 8/2001 |

* cited by examiner

*Primary Examiner*—Melvin Jones
(74) *Attorney, Agent, or Firm*—Darby & Darby

(57) ABSTRACT

An evaporator for refrigeration systems, comprising a set of tubes (20) arranged in series, spaced and parallel in relation to each other, carrying a refrigerant fluid and which are incorporated to and trespass a plurality of fins (10) arranged in multiple rows extending transversally to the direction of a forced airflow (F). The fins (10), which are incorporated to the first and second tubes (20) are spaced from each other by a larger distance (d), when they are operatively associated with a refrigerating environment, and by a smaller distance (d), when they are operatively associated with a freezing environment. Said distances (d) decrease at each two subsequent tubes (20), until reaching at least the third tube (20), said distance being then maintained at a minimum value for the other subsequent tubes (20).

12 Claims, 4 Drawing Sheets

TÉCNICA ANTERIOR

TÉCNICA ANTERIOR

TECNICA ANTERIOR

TÉCNICA ANTERIOR

EVAPORATOR FOR REFRIGERATION SYSTEMS

FIELD OF THE INVENTION

The present invention refers to the construction of an evaporator for refrigeration systems, more particularly to the arrangement of the fins of an evaporator of the tube-fin type for refrigeration systems with forced ventilation, generally used in refrigerators, freezers and other refrigeration appliances.

BACKGROUND OF THE INVENTION

The refrigeration systems with forced ventilation usually applied to refrigerators and freezers, generally use a compact evaporator of the tube-fin type comprising a plurality of fins incorporated to and trespassed by a set of tubes arranged in series in the form of a coil and carrying a refrigerant fluid. A forced airflow is forced to pass through the evaporator, which airflow is drawn from the inside of an environment to be cooled, in order to be refrigerated by the evaporator and discharged back to the interior of said environment, as it occurs for example in the refrigerating or freezing compartments of a refrigeration appliance.

These evaporators are constructed to assure a certain acceptable degree of thermal exchange between the forced airflow that is forced to pass over the tubes of the evaporator and over the fins orthogonally affixed to said tubes. However, since the heated air to be forced through the evaporator contains humidity in a higher or lower degree as a function of the operation to which the environment to be refrigerated is submitted, this humidity tends to condensate, causing the formation of ice in the evaporator.

The formation of ice occurs in a non-uniform way in the evaporator, with the ice accumulating more intensively on the leading edge of the fins and the tube, that is, at the region in which the airflow enters into the evaporator, restraining the airflow cross section between the fins.

Aiming at maintaining an adequate performance of the evaporator during the operation of the refrigeration system to which it is coupled, it is necessary to periodically remove, with a certain frequency, the ice accumulated in the evaporator. The defrost operations are usually automatically effected by the control system of the refrigeration appliance, generally a refrigerator, freezer, or a combined appliance with both functions.

The evaporators of the tube-fin type considered herein have been developed with the purpose of enhancing the heat transfer, increasing the thermal efficiency and allowing the use of more compact components of lower cost.

Following the evolutional process, the evaporator E had the fins 10 thereof modified, from a continuous form, as illustrated in FIG. 1 of the attached drawings, extending along the length of the evaporator according to the direction of the forced airflow path, to an interrupted form defined by fins that are mutually spaced, not only transversally to the direction of the forced airflow path, but also longitudinally along the length of the evaporator, as illustrated in FIG. 2 of the drawings, making the fins 10 be longitudinally arranged in rows that are transversal to the direction of the airflow path, with the fins 10 of each row being mutually parallel and spaced.

With the objective of imparting more capacity to the evaporator E to operate with the non-uniform pattern of ice formation, but allowing an operation that continues to comply with the requirements of thermal exchange efficiency, a constructive arrangement is usually employed, according to which the spacing between the fins 10 of the same row decreases from the first row of fins 10 provided close to the air inlet region of the evaporator E, to the last row of fins 10 provided close to the air outlet region of the evaporator, as illustrated in FIG. 2, which also shows, in a simple way, the non-uniform formation of ice G on the fins 10 and tubes 20 of the evaporator E. Nevertheless, the known decreasing variation of the spacing between the fins 10 of each row can, as a function of the distribution flexibility made possible, lead to different evaporator configurations, which are constructed either to increase the thermal exchange efficiency to the detriment of the capacity of the evaporator to operate with a certain degree of ice formation, or to increase said capacity to the detriment of the thermal efficiency of the evaporator E.

FIG. 3 of the enclosed drawings illustrates, schematically and partially, an arrangement of fins 10, in which the spacing therebetween has been calculated to increase the thermal exchange efficiency, to the detriment of the capacity to operatively support a certain degree of formation of ice G. The formation of ice G tends to prematurely obstruct the passage of the forced airflow through the evaporator.

FIG. 4, similarly to FIG. 3, illustrates an arrangement of fins 10, in which the spacing therebetween aimed at increasing the capacity of the evaporator to operate with the formation of ice G, to the detriment of the thermal exchange efficiency. The result of this arrangement is the provision of an evaporator that requires less frequent defrost operations, but which operates with low efficiency in terms of heat transfer.

OBJECT OF THE INVENTION

It is the object of the present invention to provide an evaporator of the tube-fin type for refrigeration systems with forced ventilation, presenting a fin distribution which allows optimizing the compromise between the capacity of thermal exchange with a forced airflow that is forced to pass through the evaporator, and the capacity of said evaporator to operate with the formation of ice and thus maximize its thermal performance.

SUMMARY OF THE INVENTION

According to the general object mentioned above, the present invention is applied to an evaporator to be used in refrigeration systems of refrigerators, freezers, combined appliances, and other refrigeration appliances. The present evaporator is of the type that comprises a set of tubes arranged in series, spaced and parallel in relation to each other, carrying a refrigerant fluid and which are incorporated to and trespass a plurality of fins arranged in multiple rows extending transversally to the direction of a forced airflow that is forced to pass through the evaporator and through an environment to be refrigerated, each row being formed by a plurality of fins arranged substantially parallel to the direction of the forced airflow and incorporated to at least one of said tubes.

According to the invention, the fins 10, which are incorporated to the first and second tubes 20, according to the direction of the forced air flow F, are spaced from each other by a larger distance d, when they are operatively associated with a refrigerating environment, and by a smaller distance d, when they are operatively associated with a freezing environment. Said distances d decrease at each two subsequent tubes 20, until reaching at least the third tube 20, said distance being then maintained at a minimum value for the other subsequent tubes 20. The constructive arrangement proposed by the present invention allows obtaining an optimum coefficient of thermal exchange for the evaporator, which can have its fins arranged to operate with forced airflows circulating through different environments to be refrigerated, with the arrangement being made so that a higher level of ice formation in the evaporator region is supported without significantly affecting the thermal exchange efficiency.

BRIEF DESCRIPTION OF THE DRAWINGS

The invention will be described below, with reference to the attached drawings, in which.

DESCRIPTION OF THE ILLUSTRATED EMBODIMENTS

Figure 1:
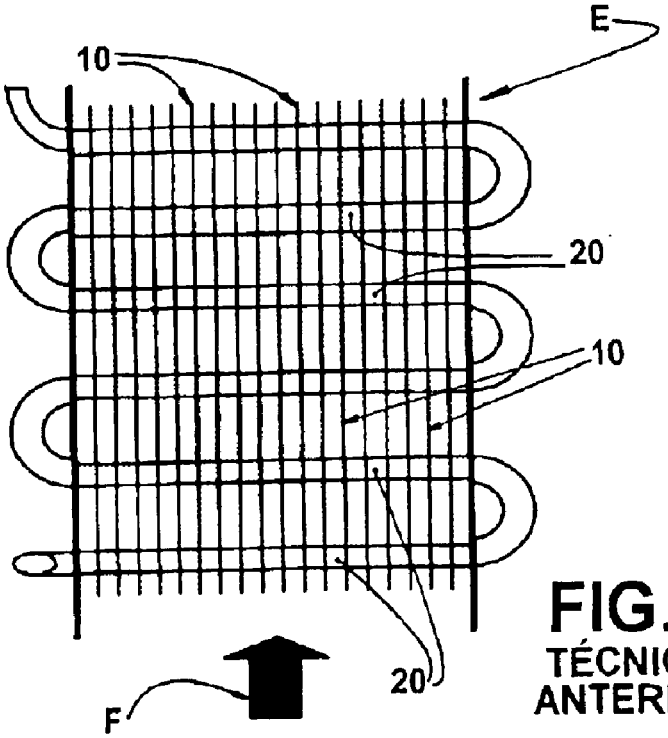
FIG. 1 is a somewhat schematic front view of a prior art evaporator of the tube-fin type, with each fin being constructed in a single continuous piece incorporated transversally to all the tubes of the evaporator and trespassed by said tubes.
Figure 2:
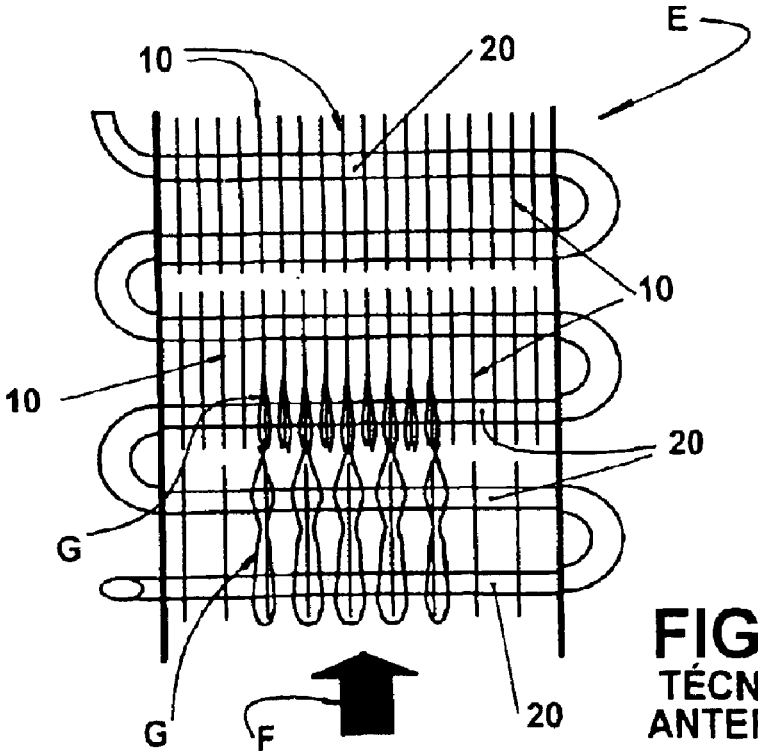
FIG. 2 is a similar view to that of FIG. 1, but illustrating a prior art fin-tube evaporator, with the fins arranged in rows transversally to the forced airflow, each row being incorporated to a respective pair of adjacent tubes.
Figure 3:
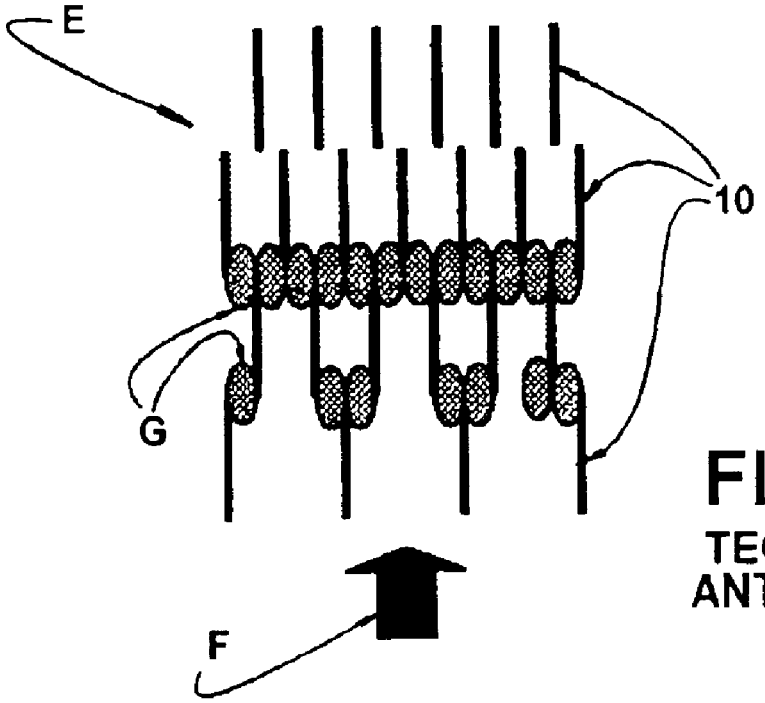
FIGS. 3–4 are schematic views of arrangements of fins disposed in rows, according to prior art arrangements, illustrating the formation of ice, when priority is given to the thermal exchange efficiency and when priority is given to the resistance to ice formation, respectively.
Figure 4:
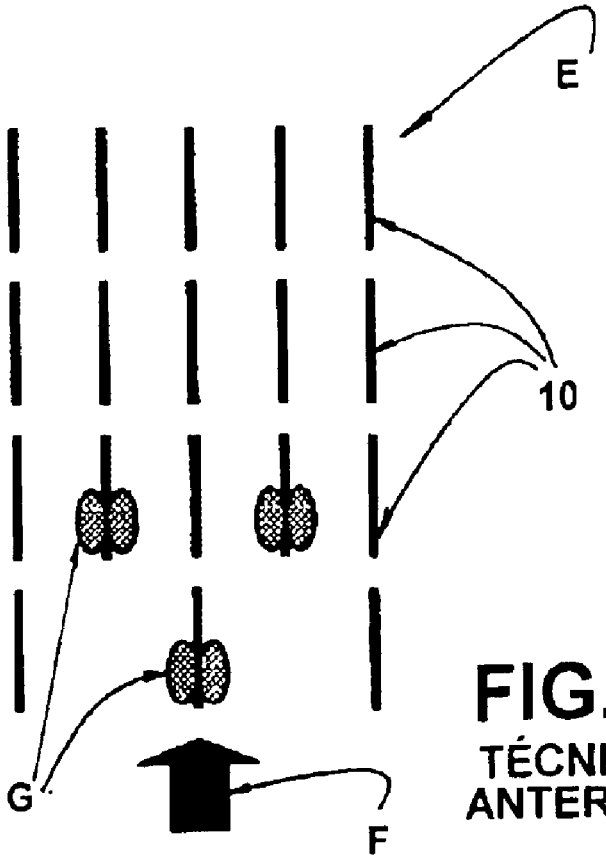
Figure 5:
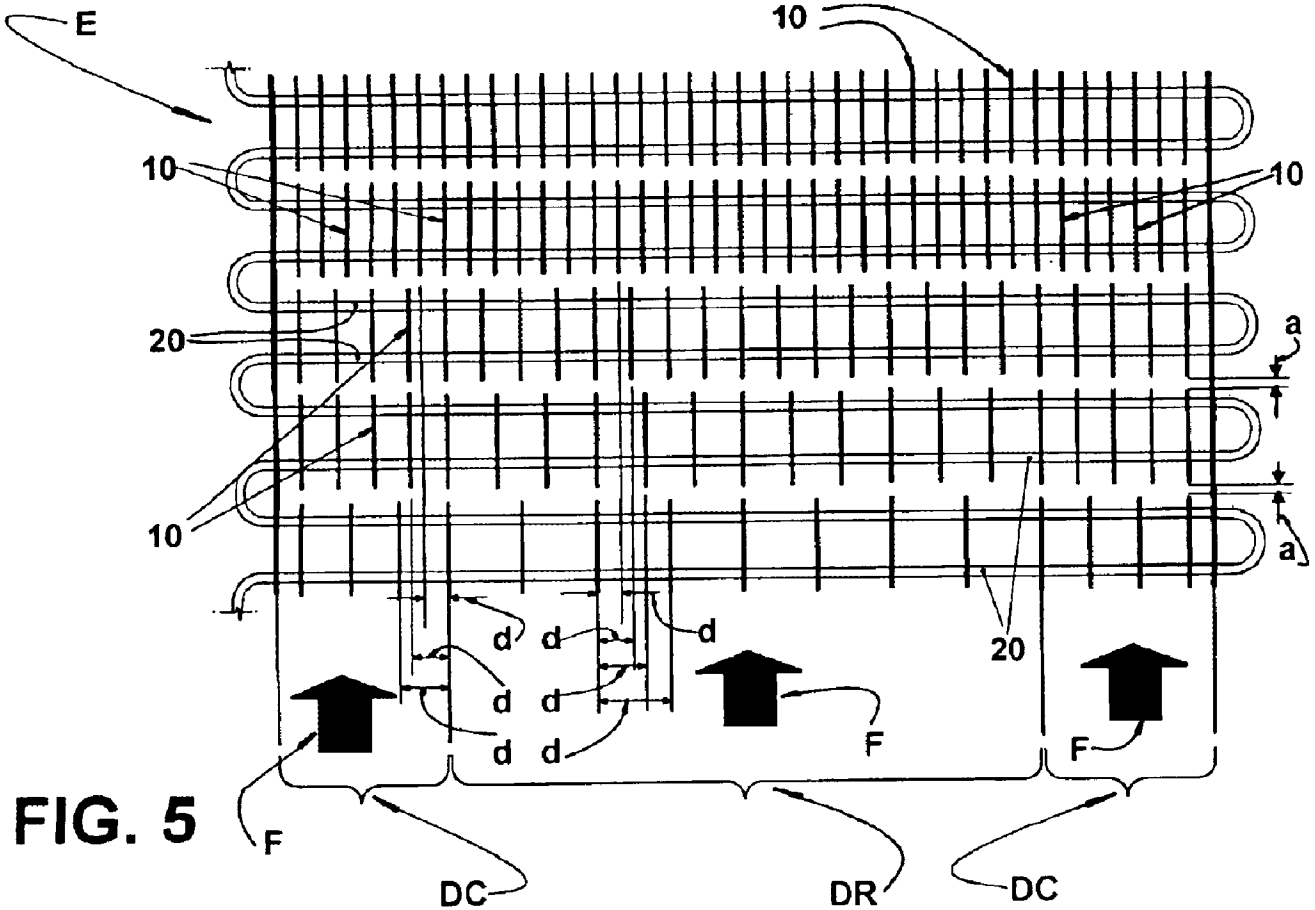
FIG. 5 is a schematic front view of an evaporator of the fin-tub type, serving both a refrigerating environment and a freezing environment, and having the fins arranged according to a first embodiment of the invention.
Figure 6:
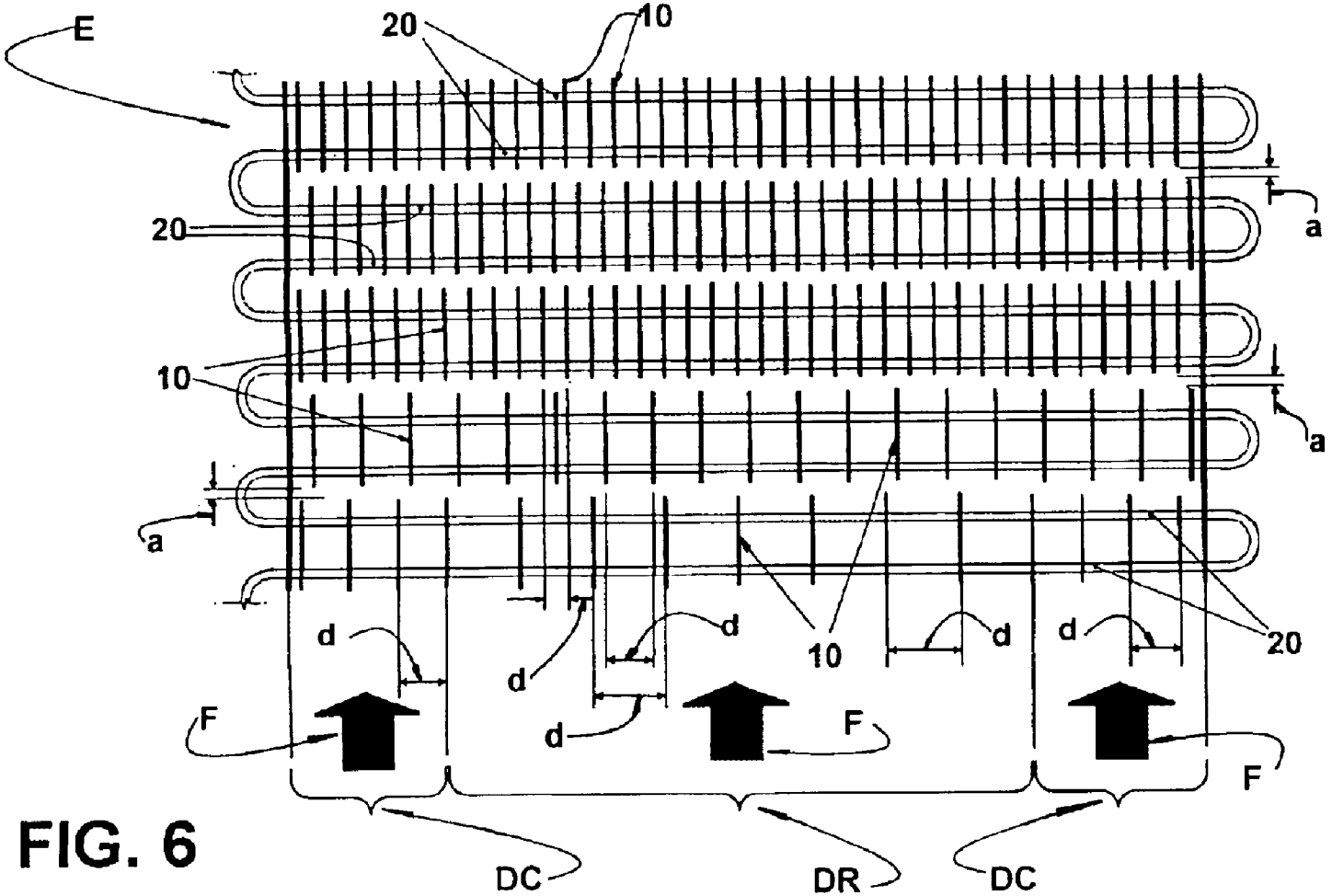
FIG. 6 is a view similar to that of the previous figure, but illustrating the fins arranged according to another embodiment of the invention.

As illustrated in FIGS. 5 and 6, the evaporator E of the present invention comprises a plurality of fins 10 arranged in multiple rows, extending transversally to the direction of a forced airflow F that is forced to pass through the evaporator E, as well as through one or more environments to be refrigerated (not illustrated) and which can be defined, for example, by a refrigerating environment, such as the compartment of a refrigerator, which is refrigerated at a temperature of about 5° C. to about 0° C., and by a freezing environment, such as the compartment of a freezer, which is refrigerated at a temperature of about −10° C. to about −20° C.

The forced airflow F is produced by a fan (not illustrated), which is adequately mounted in series with the air circulation to be produced through the evaporator and through the respective environment(s) to be refrigerated.

The fins 10 are obtained from a plate made of a material of high thermal conductivity, with a thickness generally of about 0.1–0.2 mm and presenting a rectilinear embodiment.

In the illustrated embodiments, the fins 10 have the same dimensions and are arranged in rectilinear alignments in each row, with the rows being spaced from each other by a spacing "a", which will be better defined below.

As illustrated, the evaporator E further comprises a set of tubes 20 arranged in series, spaced from and parallel to each other, carrying a refrigerant fluid and which are incorporated to the fins 10, trespassing them orthogonally.

In the constructions illustrated in FIGS. 5 and 6, each row of fins 10 is incorporated to a respective pair of adjacent tubes 20, however it should be understood that each row of fins 10 can be incorporated to a single tube 20.

According to the invention, the fins 10 incorporated to the first and second tubes 20, taking in consideration the direction of the forced airflow F, are spaced from each other by a distance "d" that varies from 3X to 4X, when they are operatively associated with a refrigerating environment, with the constant "X" ranging from 4 to 7 mm. This is the condition for the mutual distance of the fins 10 provided at the inlet region of the forced airflow F in the evaporator E and incorporated to the first and second tubes 20, when these fins 10 are operatively associated with a refrigerator compartment (refrigerating environment), whose air contains a higher amount of humidity which will form the ice G more intensively at the inlet region of the evaporator E.

In case the fins 10 are operatively associated with a freezing environment, such as a freezer compartment, with a lower amount of humidity in the circulating air, the distance "d" between the fins 10 incorporated to the first and second tubes 20 varies from 2X to 3X, that is, it is maintained slightly smaller than that applied to the same fins 10 operating with the forced airflow coming from a refrigerating environment.

In the constructions illustrated in FIGS. 5 and 6, the evaporator E is constructed to operate simultaneously with a refrigerating environment and with a freezing environment, which situation is common at the combined refrigeration appliances that comprise a refrigerating compartment and a freezing compartment.

In this type of construction, the evaporator E presents its fins 10 arranged in a set of fins, occupying a cross section area corresponding to the cross section area of a respective duct DR and DC for the return of the forced airflow F from the environment to be refrigerated and operatively associated with said set of fins 10 that follows a respective pattern of mutual distance. In the illustrated examples, the central fins 10 are arranged to operate with the forced airflow coming from a refrigerating environment through a duct DR, while the lateral fins 10 are arranged to operate with the forced airflow coming from a freezing environment through respective sections of the duct DC.

According to the direction of the forced airflow F that is forced to pass through the evaporator E, the distance "d" between the fins 10 subsequent to those incorporated to the first and second tubes 20 decreases at each two subsequent tubes 20, until reaching at least the third tube 20, said distance being then maintained with the value "X", until reaching the last tube 20.

For the fins 10 operatively associated with the refrigerating environment, the distance "d" decreases by a value corresponding to "X" from each two adjacent tubes 20 to the two subsequent tubes 20. However, for the fins 10 operatively associated with the freezing environment, said decrease of the distance "d" is made by values corresponding to X/2 for the lower limit, and from X/2 to X for the upper limit. Preferably, the upper limit for the decrease of the distance "d" between the fins 10 operatively associated with the freezing environment is X between the fins 10 incorporated to the first and second tubes 20 and those incorporated to the third and fourth tubes 20, and X/2 from these last fins 10 to those incorporated to each of the other pairs of subsequent tubes 20, until reaching the minimum distance "X" that will be maintained until reaching the fins 10 incorporated to the last tube 20, close to the outlet region of the forced airflow F of the evaporator E.

Still according to the invention, the spacing "a" between each two consecutive rows of fins 10 varies from X/3 to X/2, preferably being of about 1.75 mm, and the adjacent rows, which present the same distance "d" between the fins 10, have their fins 10 preferably and longitudinally offset in relation to the fins of the adjacent rows, in order to increase the contact of the mass of the forced airflow F therewith in a region of the evaporator E that is subject to a reduced degree of formation of ice G.

In the embodiment shown in FIG. 5, the distance "d" between the fins 10 operatively associated with the refrigerating environment, that is, between the fins 10 associated with the central duct DR, is preferably of about 15 mm for the fins incorporated to the first and second tubes 20, about 10 mm for the fins 10 incorporated to the third and fourth tubes 20, about 7.5 mm for the fins 10 incorporated to the fifth and sixth tubes 20, and about 5 mm for the fins 10 incorporated to the other tubes 20 of the evaporator E.

For the fins 10 operatively associated with the freezing environment, that is, the fins 10 associated with the lateral ducts DC, the distance "d" is preferably of about 10 mm for the fins 10 incorporated to the first and second tubes 20, and about 7.5 mm for the fins 10 incorporated to the third, fourth, fifth and sixth tubes 20, and of about 5 mm for the fins 10 incorporated to the other tubes 20.

In the embodiment of FIG. 5, the distance "d" between the fins 10 operatively associated with the refrigerating environment is decreased at each consecutive pair of tubes 20 until reaching the seventh tube 20, while the distance "d" between the fins 10 operatively associated with the freezing environment is decreased only from the second tube 20 to the third tube 20, and from the sixth tube 20 to the seventh tube 20.

In the embodiment of FIG. 6, the distance "d" between the fins 10 operatively associated with the refrigerating environment is preferably of about 15 mm for the fins 10 incorporated to the first and second tubes 10, about 10 mm for the fins 10 incorporated to the third and fourth tubes 20, and of about 5 mm for the fins 10 incorporated to the other tubes 20. For the fins 10 operatively associated with the freezing environment, the distance "d" is preferably of about 10 mm for the fins 10 incorporated to the first, second, third and fourth tubes 20, and of about 5 mm for the fins 10 incorporated to the other tubes 20.

The constructive arrangement described above allows for the fins to be mutually spaced, as a function of the characteristics of the airflow that is forced to pass therethrough, and as a function of their positioning along the longitudinal extension of the evaporator, allowing both the thermal exchange efficiency and the operational resistance to ice formation to be simultaneously optimized.

What is claimed is:

1. An evaporator for refrigeration systems, comprising:

a set of tubes arranged in series, spaced and parallel in relation to each other, carrying a refrigerant fluid; and a plurality of fins, which are incorporated to and trespass the set of tubes, arranged in multiple rows and extending transversally to the direction of a forced airflow that is forced to pass through the evaporator and through an environment to be refrigerated, each row being formed by a plurality of fins arranged substantially parallel to the direction of the forced airflow and incorporated to at least one of said tubes wherein the fins, which are incorporated to the first and second tubes according to the direction of the forced air flow, are spaced from each other by a larger distance, when they are operatively associated with a refrigerating environment, and by a smaller distance, when they are operatively associated with a freezing environment, said distances decreasing at each two subsequent tubes, until reaching at least the third tube, said distance being then maintained at a minimum value for the other subsequent tubes.

2. The evaporator as set forth in claim 1, wherein the distance between the fins incorporated to the first and second tubes varies from 3X to 4X for the fins operatively associated with the refrigerating environment, and from 2X to 3X for the fins operatively associated with the freezing environment, the constant "X" varying from 4 to 7 mm, and the limits for the variation of the distance between the fins associated with each two adjacent tubes decreasing for the two subsequent tubes by a value corresponding to "X" for the fins operatively associated with the refrigerating environment, and corresponding to X/2 for the lower limit, and from X2 to X for the upper limit for the fins operatively associated with the freezing environment, said decrease of the distance occurring until reaching the value "X", which is maintained for the other subsequent tubes, the spacing between the rows of fins varying from X/3 to X/2.

3. The evaporator as set forth in claim 1, wherein the fins of each row have the same dimensions.

4. The evaporator as set forth in claim 3, wherein the fins of each row are arranged according to rectilinear alignments.

5. The evaporator as set forth in claim 1, wherein the fins of each row are incorporated to a respective pair of adjacent tubes.

6. The evaporator as set forth in claim 1, which is simultaneously and operatively associated with a refrigerating environment and with a freezing environment, wherein each row presenting the fins mutually spaced by a distance larger than "X" comprises a set of fins occupying a cross section area corresponding to the cross section area of a respective duct for the return of the forced airflow from the environment to be refrigerated and operatively associated with said set of fins, the distance between the latter being dimensioned as a function of the characteristics of the refrigeration to be imparted to the respective environment to be refrigerated by the respective set of fins.

7. The evaporator as set forth in claim 1, wherein the distance between the fins, which are operatively associated with the refrigerating environment, is about 15 mm for the fins incorporated to the first and to the second tubes, about 10 mm for the fins incorporated to the third and to the fourth tubes, about 7.5 mm for the fins incorporated to the fifth and to the sixth tubes, and about 5 mm for the fins incorporated to the other tubes of the evaporator.

8. The evaporator as set forth in claim 1, wherein the distance between the fins, which are operatively associated with the freezing environment, is about 10 mm for the fins incorporated to the first and second tubes, about 7.5 mm for the fins incorporated to the third, fourth, fifth, and sixth tubes, and about 5 mm for the fins incorporated to the other tubes.

9. The evaporator as set forth in claim 1, wherein the distance between the fins, which are operatively associated with the refrigerating environment, is about 15 mm for the fins incorporated to the first and second tubes, about 10 mm for the fins incorporated to the third and fourth tubes, and about 5 mm for the fins incorporated to the other tubes.

10. The evaporator as set forth in claim 1, wherein the distance between the fins, which are operatively associated with the freezing environment is about 10 mm for the fins incorporated to the first, second, third, and fourth tubes, and about 5 mm for the fins incorporated to the other tubes.

11. The evaporator as set forth in claim 1, wherein the adjacent rows presenting the same distance between the fins have their fins longitudinally offset in relation to the fins of the adjacent rows.

12. The evaporator as set forth in claim 1, wherein the rows of fins maintain a spacing of about 1.75 mm from each other.

* * * * *